United States Patent [19]

Sistino

[11] 3,952,659

[45] Apr. 27, 1976

[54] FLATTENED SPHERICAL SHOT

[75] Inventor: Alphonse J. Sistino, Guilford, Conn.

[73] Assignee: Olin Corporation, New Haven, Conn.

[22] Filed: June 20, 1974

[21] Appl. No.: 481,074

[52] U.S. Cl. ..... 102/42 R; 102/92.1

[51] Int. Cl.[2] ..... F42B 7/04; F42B 11/00

[58] Field of Search ..... 102/42 R, 42 C, 67, 102/91, 92.1

[56] References Cited

UNITED STATES PATENTS

| | | | |
|---|---|---|---|
| 111,377 | 1/1871 | Paine | 102/42 C |
| 487,028 | 11/1892 | Ginalsky | 102/42 C |
| 631,703 | 8/1899 | Dunn | 102/67 |
| 1,583,559 | 5/1926 | Kenneweg | 102/42 R |
| 2,343,818 | 3/1944 | Sweeley | 102/42 R |
| 2,767,656 | 10/1956 | Zeamer | 102/42 R |
| 3,208,382 | 9/1965 | Foote et al. | 102/42 C |
| 3,667,390 | 6/1972 | Medin et al. | 102/92.1 |

*Primary Examiner*—Charles T. Jordan

*Attorney, Agent, or Firm*—Donald R. Motsko; William W. Jones

[57] ABSTRACT

Shot for use in ammunition with each shot pellet having six equally spaced, substantially flattened faces joined by spherical portions which can be randomly packed in a container with a density about 14 per cent greater than the packing density obtained with standard spherical shot of the same weight.

7 Claims, 3 Drawing Figures

FLATTENED SPHERICAL SHOT

SUMMARY OF THE INVENTION

This invention relates to a novel type of shot which has the ballistics of standard spherical shot and which can be packed with a pellet density 12 to 16 per cent greater than spherical shot, thereby allowing a greater number of shot pellets to be packaged in a container of a given size.

The shot of this invention can be described as comprising spherical shot pellets which have been provided with six equally spaced, substantially flat faces which faces are separated from each other by spherical portions. In this configuration, the shot has the flight characteristics or ballistics of standard spherical shot of equivalent weight but packs to a greater density than is obtainable with standard spherical shot. The diameter between flattened faces of the flattened spherical shot pellets of this invention is substantially less than the diameter of spherical shot pellets of the same weight. The diameter between opposed spherical surfaces on the shot pellets of this invention is greater than the diameter of spherical shot pellets of the same weight. The configuration of the flattened spherical shot of this invention allows a packing density which ranges from about 12 to 16 per cent greater than what is obtainable with standard spherical shot packed in an equivalent container. In actual practice with random packing of the shot of this invention, results obtained indicate that flattened spherical shot can be packaged in a given space with 14 per cent more pellets than conventional spherical shot of the same weight.

At the present time, spherical shot is the standard type of shot used in shotshells and related ammunition throughout the world. The prior art does suggest that shot pellets might be made in the form of cylinders (see U.S. Pat. No. 2,343,818), cubes (see U.S. Pat. No. 487,028), and discs (see U.S. Pat. No. 1,583,559). The prior art suggests that variations in the shape of shot pellets from the standard spherical shot pellets can increase packing density or alter pattern. Packing density is increased in accordance with prior art teachings by cutting a solid slug into smaller pieces thereby eliminating all space between the shot (U.S. Pat. No. 487,028). Pattern is changed by altering the shape and therefore the flight characteristics in a way which will bring about a desired result. It can be expected that a disc, cylinder or cube will fly differently than a sphere. The prior art suggestion for eliminating or reducing the space between shot and thereby providing more shot in a given space requires precise stacking of the shot (U.S. Pat. Nos. 487,028 and 111,377) and does not take into consideration random packing which is the way shot is packaged. With the flattened spherical shot of the present invention, however, it is possible to maintain flight characteristics of the shot which are substantially identical to the flight characteristics of standard spherical shot and yet obtain a substantially greater packing density with random loading of the shot. The shooter is therefore able to obtain the advantage of having more shot packed in a given space thereby increasing the probability of a hit. This invention also allows the shooter to have a heavier load (more pellets of the same weight) packaged into the limited space which is available in a conventional shotshell. This invention also finds particular application in those situations where one is required to substitute a lighter material for the shot such as, for example, iron shot for lead shot. This is required under certain circumstances and shooting conditions for environmental reasons. If iron shot formed in accordance with the teachings of this invention is packaged in the limited space available in a conventional shotshell, more shot will be able to be placed into that space and, therefore, the total weight of shot loaded will begin to approach the weight of standard spherical lead shot which might be packaged in that same space.

It is, therefore, a primary object of this invention to provide a new shape for shot which allows it to be packaged with a greater packing density than standard spherical shot, but which has substantially the same flight characteristics as spherical shot.

It is a further object of this invention to provide a new shape for shot pellets which allows more pellets to be packaged in a given volume than what is obtainable with standard spherical shot.

These and other objects of the invention will be more readily understood from the following detailed description considered in connection with the accompanying drawings wherein.

DETAILED DESCRIPTION

Figure 1:
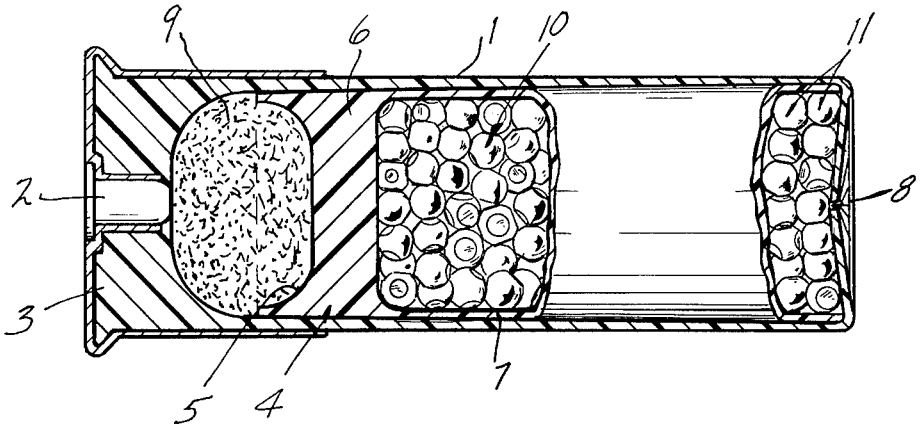
FIG. 1 is a cutaway side view of a conventional shotshell loaded with the shot of this invention.
Figure 2:
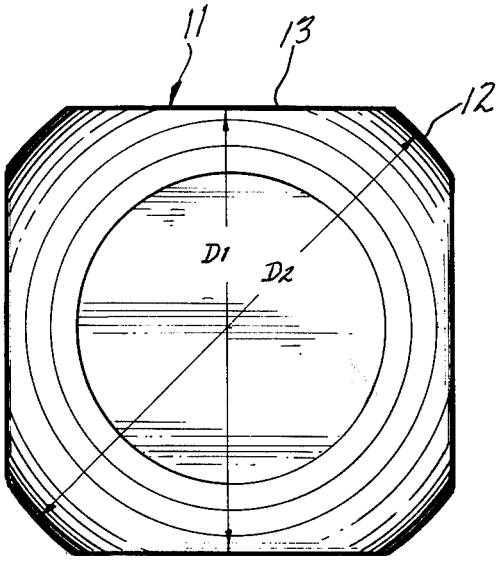
FIG. 2 is a plan view of flattened spherical shot made in accordance with this invention.
Figure 3:
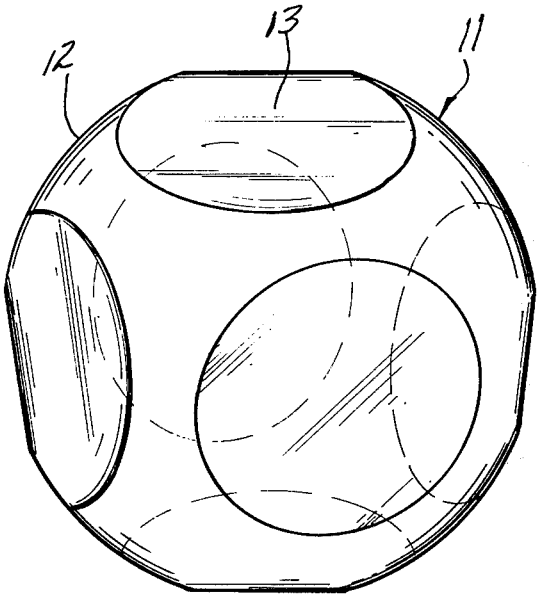
FIG. 3 is a perspective view of shot formed in accordance with this invention.

Referring now to FIG. 1 of the drawings, I show a shotshell having a case 1. The shotshell case is provided with a primer 2 which is fitted into the base 3 of the case. The interior of the case is provided with a wad structure generally indicated 4. The wad structure 4 includes an over powder cup wad portion 5, a filler portion 6 and a shot pouch 7 which extends forward toward the closure 8 of the shell. Between base 3 and wad portion 5 is a powder charge 9. The wad structure 4 is shown in FIG. 1 as being a one-piece integral plastic molding. It may, however, be formed as a separate over powder wad, filler wad and shot pouch. The shot pouch 7 is filled with a shot column 10. The shot column 10 is comprised of individual pellets 11 each of which is formed in accordance with my invention. Each shot pellet 11 as shown in FIGS. 2 and 3 includes a generally spherical portion 12 and six equally spaced, substantially flat faces 13.

The flattened spherical shot of this invention might best be characterized as standard spherical shot which has been reformed to include six equally spaced, substantially flat faces 13. The diameter of the pellet between opposed flat faces as shown at D1 in FIG. 2 is less than the diameter of corresponding spherical shot of equivalent weight. The diameter across spherical portions of the pellet as indicated at D2 in FIG. 2 is greater than the diameter of standard spherical shot of the same weight. As an example, No. 2 standard spherical shot pellets have an average diameter of 0.151 inch. The corresponding flattened spherical shot of this invention which would correspond in weight to No. 2 shot would have a dimension D2 as seen in FIG. 2 averaging 0.163 inch and a dimension D1 across the flattened portion averaging 0.136 inch.

I have found that shot having the configuration described herein can be packaged in the normal shot receiving portion of a shotshell, such as shot pouch 7 as seen in FIG. 1, to a packing density which averages approximately 14 per cent more pellets than what is obtainable if equivalent standard spherical shot is packaged in the same space. The statement above assumes random packing of the shot pellets and vibrating the shell to obtain maximum packing density. The comparison of 14 per cent greater packing density is made with an equivalent shotshell which is packaged with standard spherical shot and also vibrated to maximize packing density. Theoretically, it would be possible to obtain even greater packing density with standard shot or with the shot of this invention if the pellets were individually stacked in layers to minimize the space between individual pellets. Such individual stacking of pellets, however, is neither feasible nor practical in the day-to-day manufacture of shotshells and the like.

The six-sided, flattened spherical shot of this invention also has the desirable property of flying with substantially the same flight characteristics and penetration as spherical shot which is the standard of the ammunition industry. Tests made with the shot of this invention indicate that the average velocities measured at 1 yard and at 40 yards are not significantly different than the velocities which are obtained with standard equivalent weight spherical pellets. Testing the patterns obtained with the flattened spherical shot of this invention and comparing these patterns with patterns obtained from standard spherical shot indicate a somewhat greater dispersion of the pellets having the flattened spherical configuration described herein. This difference in dispersion can probably be attributed to the slightly different launch and aerodynamic characteristics which can be expected with shot configured in accordance with this invention. The difference from the viewpoint of the shooter, however, is found to be insignificant because a greater number of pellets are contained in a shot column when the shot is made in accordance with this invention. The result, therefore, is that in counting the number of pellets which would be contained in a 30-inch circle at 40 yards to determine pattern, one finds that there are actually more pellets on average delivered to the target area with the shot configuration of this invention than with standard spherical shot of equivalent weight. The probability of a hit, therefore, increases with the shot of this invention compared with standard round shot.

As an example of the superior loading density characteristics of the flattened spherical shot of this invention, a test was made in which No. 2 size spherical shot pellets having an average diameter of 0.151 inch were loaded into five shells each having an available shot column volume of approximately 0.44 cubic inch. Flattened spherical shot pellets of the same weight as standard No. 2 shot and having an average diameter between the flattened portions of 0.136 inch and between the spherical portions of 0.163 inch were loaded into five shells each having an available shot column volume of 0.44 cubic inch. The shells were all vibrated to obtain maximum packing density. Results obtained with the No. 2 size spherical shot pellets showed an average 135 pellets in the shot column compared to 154 pellets of the flattened spherical shot of this invention. The average increase was 19 more pellets in the flattened spherical shot column or about 14 per cent more pellets.

Comparable results can be expected with different pellet sizes and different shot column volumes.

What is described herein as new and inventive shall be limited only by the scope of the following claims.

I claim:

1. A shot pellet having six equally spaced, substantially flat faces entirely surrounded by generally spherical surface portions.

2. The shot pellet of claim 1 in which the diameter of said pellet between said flat faces is less than the diameter between spherical portions.

3. The shot pellet of claim 1 in which the diameter of said pellet between said flat faces is less than the diameter of a spherical pellet of the same weight.

4. Flattened spherical shot pellets each having six equally spaced, substantially flattened surfaces arranged in a cubical configuration connected by spherical surfaces.

5. The pellets of claim 4 in which the diameter between opposed flattened surfaces is less than the diameter of a spherical pellet of the same weight and the diameter between opposed spherical surfaces is greater than the diameter of a spherical pellet of the same weight.

6. A shotshell including a casing, a primer, a powder charge, a wad structure, pellets, and a closure, the improvement comprising the pellets in the shot column being formed with six equally spaced, substantially flattened faces entirely surrounded by spherical surfaces so that the randomly loaded shot column in said shotshell contains from 12 to 16 per cent more shot pellets than a shotshell loaded with spherical pellets of the same weight.

7. A shotshell including a casing, a powder charge in said casing adjacent one end thereof, a primer to ignite said powder charge, a plurality of shot pellets in said casing adjacent the other end thereof forming a shot column, a wad structure between said powder charge and said shot, and a closure, said shot pellets having six equally spaced, flattened surfaces arranged in a cubical configuration joined by spherical surfaces and said shot column containing in the range of 12 to 16 per cent more pellets than could be contained in the same available space with spherical pellets of the same weight.

* * * * *